US005897102A

United States Patent [19]

Sorkin

[11] Patent Number: 5,897,102

[45] Date of Patent: Apr. 27, 1999

[54] POCKETFORMER APPARATUS FOR A POST-TENSION ANCHOR SYSTEM

[76] Inventor: Felix L. Sorkin, 4115B Greenbriar Dr., P.O. Box 1503, Stafford, Tex. 77477

[21] Appl. No.: 09/007,609

[22] Filed: Jan. 15, 1998

[51] Int. Cl.[6] ..... E21B 21/00

[52] U.S. Cl. ..... 254/29 A; 29/452; 249/43; 52/223.13

[58] Field of Search ..... 254/29 A; 29/452, 29/453, 525.1; 249/43, 217; 264/229, 228; 52/223.13

[56] References Cited

U.S. PATENT DOCUMENTS

| | | | |
|---|---|---|---|
| 3,833,706 | 9/1974 | Edwards | 29/452 |
| 3,956,797 | 5/1976 | Brandestini et al. | 254/29 Z |
| 5,749,185 | 5/1998 | Sorkin | 52/223.13 |
| 5,755,065 | 5/1998 | Sorkin | 52/223.13 |

*Primary Examiner*—David A. Scherbel
*Assistant Examiner*—Lee Wilson
*Attorney, Agent, or Firm*—Harrison & Egbert

[57] ABSTRACT

A pocketformer apparatus for a post-tension anchor system including a tubular member with an outwardly flanged end, a securement member affixed to the tubular member, and a cup member having an interior opening such that the tubular member extends through the interior opening. The tubular member has an interior passageway extending from the flanged end to another end. The flanged end engages an anchor of the post-tension anchor system. The cup member is interposed between the flanged end and the securement member on the tubular member. The tubular member has an externally threaded area extending inwardly of the end opposite the flanged end. The securement member is threadedly received by the externally threaded area. An annular ring is formed on the flanged end of the tubular member so as to engage a receptacle formed on the anchor. The securement member, the cup member and the tubular member are formed of polymeric material.

24 Claims, 6 Drawing Sheets

POCKETFORMER APPARATUS FOR A POST-TENSION ANCHOR SYSTEM

TECHNICAL FIELD

The present invention relates to post-tension anchor systems generally. More particularly, the present invention relates to pocketformers which are used for the creation of a pocket in concrete adjacent an end of the tendon in the anchor system. Additionally, the present invention relates to devices for securing the pocketformer in place at the end of the anchorage system.

BACKGROUND ART

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size an number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Pre-stressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

In such post-tension construction, the tendons are anchored and cut off just inside the face of the structure in what are termed "pockets". The "pockets" surrounding the tendon end are filled with a concrete grout. A "pocketformer" is placed in the concrete adjacent to the face of the structure and against an end of the terminal anchor. After the concrete is suitably hardened, a form board is removed and the pocketformer is removed so as to expose the pocket. The ends of the tendon extend outwardly of the pocket. After the tensioning has occurred, the pocket is then filled with a concrete grout so as to be flush with the face of the structure.

FIG. 1 shows a pocketformer 10 as used in the prior art. This pocketformer 10 has a frustoconical surface 12 formed on the exterior of the pocketformer 10. The frustoconical shape 12 will define the pocket. A central tubular member 14 is formed within the interior of the frustoconical portion 12. One end 18 of the tubular member 14 will extend into the central bore of the anchor. The interior 16 of the tubular member 14 will allow the tendon to extend therethrough. Struts 20 extend between the tubular member 14 and the frustoconical portion 12. The tubular member 14 is generally centered within the interior of the frustoconical portion 12. The surface of the anchor will abut the narrow end of the frustoconical portion 12. The wide end of the frustoconical portion will abut a surface of a form board. The tubular member 14 extends through a hole formed in the form board. As such, the tendon will extend outwardly of the form board during the formation of the concrete structure.

One of the problems with the pocketformer 10, as shown in FIG. 1, is the inability to properly secure the anchor relative to the pocketformer 10. In conventional practice, long threaded members will extend through holes in the anchor member and be attached to the form board. After the concrete is hardened, it will be necessary to remove the threaded members or nails. If these items are not removed, then corrosion can occur and rust patterns will form on the facing surface of the concrete structure. Furthermore, the use of nails or threaded members for securing the anchor relative to the form board is a time consuming and labor-intensive operation. As such, a need has developed so as to allow the anchor to be removably secured to the pocketformer during the installation of the pocketformer.

In the past, various patents have issued relating to pocketformers that serve to retain the pocketformer in place, against the form board, during the installation of the anchor. For example, U.S. Pat. No. 3,844,697, issued on Oct. 29, 1974 to H. J. W. Edwards describes an anchorage assembly including an anchor having a hollow housing and a means therein for engaging a stressing tendon passing therethrough. The hollow member is removably attached to the anchor housing and to the concrete formwork and fixing the relative position of the anchor housing to the formwork. The member surrounds the tendon between the anchor housing and the formwork and is adapted and arranged to be detached from the anchor housing after the concrete has set. A cavity forming spacer is provided which surrounds the member and is disposed between and seals against the anchor housing and the formwork to form a cavity in the concrete.

U.S. Pat. No. 3,956,797, issued on May 18, 1976 to Brandestini describes a pocketformer apparatus in which the pocketformer is initially threaded into the interior opening of a steel anchor. As such, the steel anchor will have internal threads which threadedly receive the external threads on the end of the pocketformer. The pocketformer includes an interior bore through which the tendon passes. On the opposite end of the pocketformer is a threaded section which extends on an opposite side of the form board from the anchor. A threaded nut is threadedly received by the threads of the pocketformer which extend on the opposite side of the form board.

U.S. Pat. No. 4,053,974, issued on Oct. 18, 1977 to Howlett et al. describes a method of forming a concrete structure with a recess to receive an anchorage. This method includes a tubular mounting means mounted to extend over the tendon and through an opening in a bearing or anchor plate in order to secure the bearing plate in a fixed position aligned in relation to the tendon for casting the bearing plate into the concrete member in a predetermined orientation. A spacing means is provided between the form board and the anchor plate so as to allow the anchor plate to be cast into a recess in the concrete member.

U.S. Pat. No. 4,363,462, issued on Dec. 14, 1982 to Wldodkowski et al. teaches a formwork for a concrete structural member. This device includes a recoverable formwork part. The recoverable part has an axially elongated sheath which closely encloses a tendon. A cup-shaped part is formed integrally with the sheath and is arranged to form at least a portion of the recess in the concrete member. When assembled on the formwork, one end of the sheath is arranged to be located within the concrete when it is poured and the other end is located on the exterior of the formwork. The cup-shaped part is located intermediate of the ends of the sheath and just inside the formwork. A member is engagable with the sheath for attaching it to the formwork.

It is an object of the present invention to provide a pocketformer which allows the anchor to be properly secured in place relative to the form board.

It is another object of the present invention to provide a pocketformer that allows the pocketformer to be removably attached by snap-fitting to the anchor.

It is a further object of the present invention to provide a pocketformer which is adaptable to conventional anchors.

It is still another object of the present invention to provide a pocketformer which eliminates the need for nails or threaded members for the attachment of the anchor relative to the form board.

It is still another object of the present invention to provide a pocketformer apparatus which is easy to use, relatively inexpensive, and easy to manufacture.

These and other objects and advantages of the present invention will become apparent from a reading of the attached specification and appended claims.

SUMMARY OF THE INVENTION

The present invention is a pocketformer apparatus for a post-tension anchor system which comprises a tubular member having an outwardly flanged end, a securement member affixed to the tubular member, and a cup member having an interior opening through which the tubular member extends. The tubular member has an interior passageway extending from the flanged end to another end. The tendon of the post-tension anchor system will extend through this interior passageway of the tubular member. The flanged end includes a snap-fit means for engaging the anchor of the post-tension anchor system. The cup member is interposed between the flanged end of the tubular member and the securement member on the tubular member.

Specifically, in the present invention, the tubular member has an externally threaded area extending inwardly of the end of the tubular member opposite the flanged end. The securement member is threadedly received by the externally threaded area. The securement member has an interior bore with a thread section formed therein. The thread section in the interior bore engages the externally threaded area of the tubular member. The securement member has an abutment surface facing the flanged end.

In the present invention, the flanged end of the tubular member has a receptacle means formed thereon. This receptacle means is suitable for detachably receiving a button member formed on the anchor member. The anchor member is of the type covered with a polymeric encapsulation. This encapsulation includes a tubular section formed adjacent an end of the anchor member. The button member is formed inwardly of the tubular section. The flanged end is affixed within the tubular section. Specifically, the receptacle means includes a slide surface formed on a circumference of the flanged end. A latch member is formed at an end of the slide surface. An abutment portion is formed at an opposite end of the slide surface. The button member is positioned against the slide surface and the abutment portion when the flanged end is in snap-fit engagement with the tubular section. The latch member has a spearhead shape. The wide end of the spearhead shape abuts a surface of the button member opposite the abutment portion. A compressible seal is positioned within the polymeric encapsulation of the anchor section. The flanged end is in contact with the compressible seal when the flanged end is in snap-fit engagement with the anchor member. The flanged end can be pushed against the surface of the compressible seal so as to release the button member from the receptacle means.

In the present invention, the cup member has a double oval shape. The cup member has a face at a narrow end of the double oval shape. This face is proximal the flanged end of the tubular member. The cup member has a wide end distal the flanged end. The wide end is open and has a planar edge. The securement member, the cup member and the tubular member are formed of a polymeric material.

The interior opening of the cup member is a tubular section which opens at one end of the face. The interior opening opens at an opposite end at the wide end of the cup member. The tubular section has a diameter greater than a diameter of the tubular member. This interior opening is offset from a center of the face of the cup member.

DETAILED DESCRIPTION OF THE INVENTION

Figure 1:
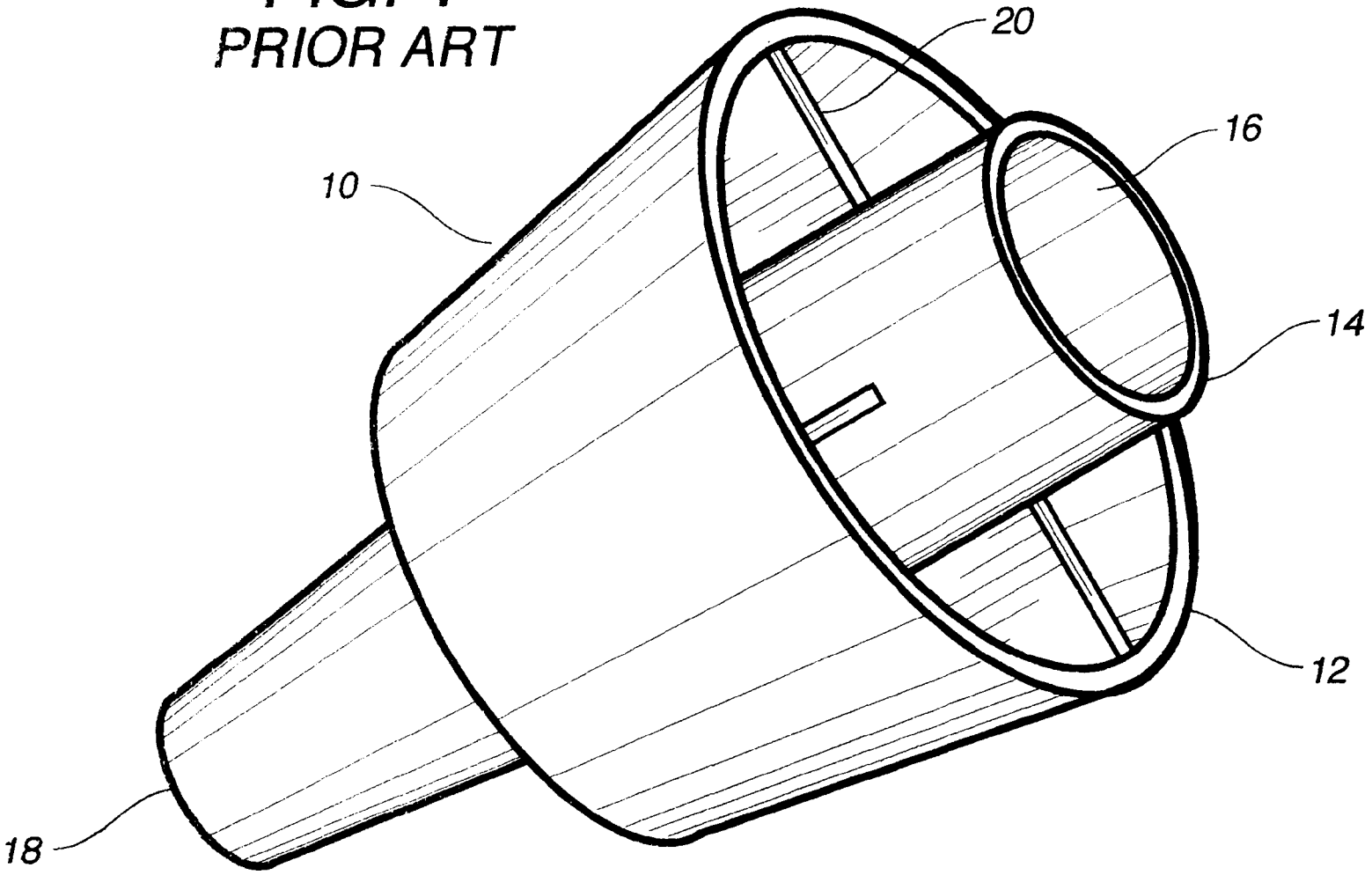
FIG. 1 PRIOR ART
FIG. 1 is a perspective view of a pocketformer as used in the prior art.
Figure 2:
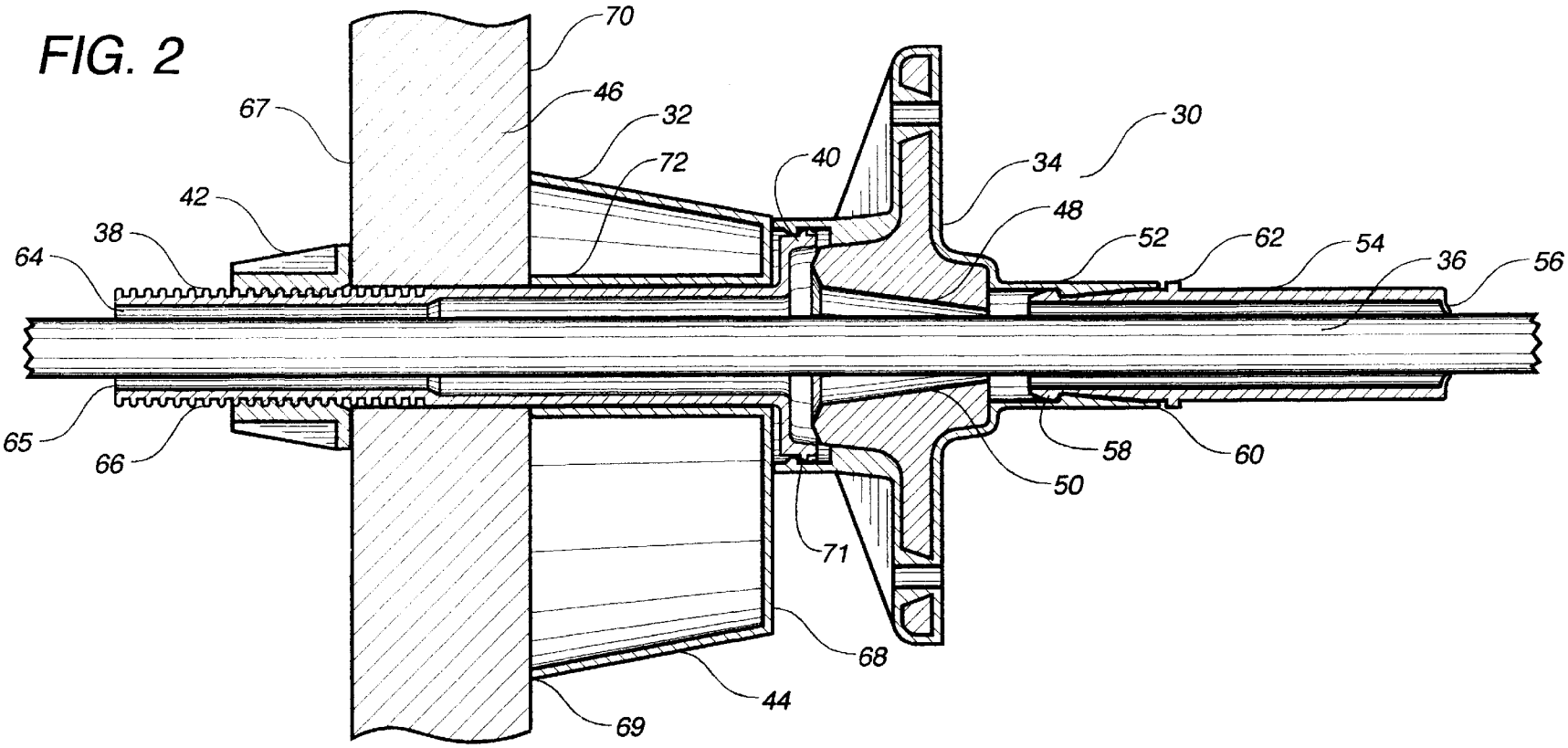
FIG. 2 is a cross-sectional side view of the pocketformer apparatus of the present invention.

Referring to FIG. 2, there is shown at 30 the post-tension system utilizing the pocketformer apparatus 32 of the present invention. The post-tension system 30 includes an anchor member 34 with a tendon 36 extending therethrough. A tubular member 38 has a flanged end 40 in snap-fit engagement with the anchor member 34. A securement member 42 is threadedly received around the exterior of the tubular member 38. A cup member 44 is placed around the exterior of the tubular member 38. The cup member 44 is interposed between the anchor member 34 and form board 46. The form board 46 is positioned between the securement member 42 and the cup member 44.

In the present invention, the anchor member 34 is an encapsulated anchor of a type commonly used in post-tension construction. The anchor member 34 includes an interior bore 48 of a tapered configuration. Wedges 50 are inserted into the tapered bore 48 so as to exert a friction fit contact with the exterior surface of the tendon 36. A tubular portion 52 of the anchor member 34 extends rearwardly of the tapered bore 48. A corrosion protection tube 54 is received within the tubular portion 52 by snap-fit engagement. A sealing area 56 is located at the end of the corrosion protection tube 54 so as to establish a liquid-resistant seal between the exterior of the tendon 36 and the interior of the corrosion protection tube 54. The tubular portion 52 and the corrosion protection tube 54 have a configuration similar to that which was described in U.S. application Ser. No. 08/914,989, filed on Aug. 20, 1997. In simple terms, the forward end 58 of the corrosion protection tube 54 is inserted into the open end 60 of the tubular portion 52 until the end 58 is snap fitted within the interior of the tubular portion 52 and the shoulder 62 is in proximity to the end 60 of the tubular portion 52. As such, the corrosion protection tube 54 will assure that liquid intrusion does not affect the integrity of the tendon 36 extending therethrough.

As can be seen, a tubular section 37 is formed on the end of the anchor member 34 opposite the tubular portion 52. This tubular section 37 is formed of polymeric material. This tubular section 37 extends outwardly of the steel anchor 39. A button member 41 is formed on the interior of this tubular section 37. As will be described hereinafter, the special latching and locking mechanism of the present invention will be in snap-fit engagement with the button member 41. A compressible seal 43 is positioned within the tubular section 37 and against a forward surface of the steel anchor 39. The compressible seal 43 is an O-ring seal with sufficient compressibility so that the flanged end 40 of the tubular member 38 can be pressed against the compressible seal 43 such that the latching and locking mechanism of the flanged end 40 of the tubular member 38 will engage the button member 41.

The pocketformer apparatus 32 of the present invention includes the tubular member 38, the securement member 42 and the cup member 44. The tubular member 38 has a tubular interior 64 through which the tendon 36 extends. The tendon 36 will have an end which extends outwardly of the end 65 of the tubular member 38. As can be seen, external threads 66 are formed on the exterior surface of the tubular member 38 adjacent to the end 58. The external threads 66 will extend for a portion of the length of the tubular member 38. In the preferred embodiment of the present invention, external threads 66 are parallel square threads. The securement member 42 is a nut-like member which includes threads portions that are threadedly received between the external threads 66 of the tubular member 38. The securement member 42 is slidable or rotatable about the threads 66 so as to be moved into surface-to-surface contact with face 67 of the form board 46.

The tubular member 38 includes a flanged end 40 which extends outwardly from an end of the tubular member 38. The flanged end 40 will have a receptacle 71 formed thereon so as to be in snap-fit engagement with the button 41 within the tubular section 37 of the anchor member 34. The receptacle 71 includes a plurality of such receptacles (as will be described hereinafter) which facilitates the snap-fit engagement. The flanged end 40 of the tubular member 38 will be removably affixed within the tubular section 37 of the anchor member 34.

The cup member 44 has a generally double oval shape with a forward face 68 and a rearward edge 69. The end of the anchor member 34 will be in surface-to-surface contact with the forward face 68 when the pocketformer apparatus is installed.

The cup member 44 has a tubular section 72 extending through the interior of the cup member 44. The tubular member 38 will be slidably received within the tubular section 72. The tubular section 72 has one end opening at face 68 and another end opening at the back edge 69 of the cup member 44. The edge 69 will open to the interior of the cup member 44 but be in coplanar relationship with the end of the tubular section 72.

In normal practice, a pocketformer apparatus 32 will be installed in the concrete structure in the manner shown in FIG. 2. When it is desired to remove the pocketformer so as to expose the pocket it is only necessary to remove the securement member 42 from the threads 66 on the tubular member 38. The form board 46 can then be removed.

After the form board 46 is removed, the exposed end 65 of the tubular member 38 is pushed inwardly in the direction toward the anchor member 34. The tubular member 38 is then rotated so as to free the receptacle mechanism on the flanged end 40 to be released from the button member 41 from the tubular section 37 of the encapsulation of the anchor member 34. The cup member 44 and the tubular member 38 are removed by pulling the exposed end 65 of the tubular member 38 outwardly. The flanged end 40 is released from the anchor member 34. The tubular member 38 can slide outwardly so as to be removed from the end of the tendon 36.

It is important to note that the tubular section 72 is offset from the center of the face 68 of the cup member 44. As a result, when the pocket of concrete is ultimately formed, there will be an area available so as to allow for the easy cutting and removal of the excess tendon 36 which extends outwardly of the end of the anchor 34. There will be an area formed in which saws, torches, arcs, or others cutting apparatus can enter so as to properly sever the tendon 36.

Figure 3:
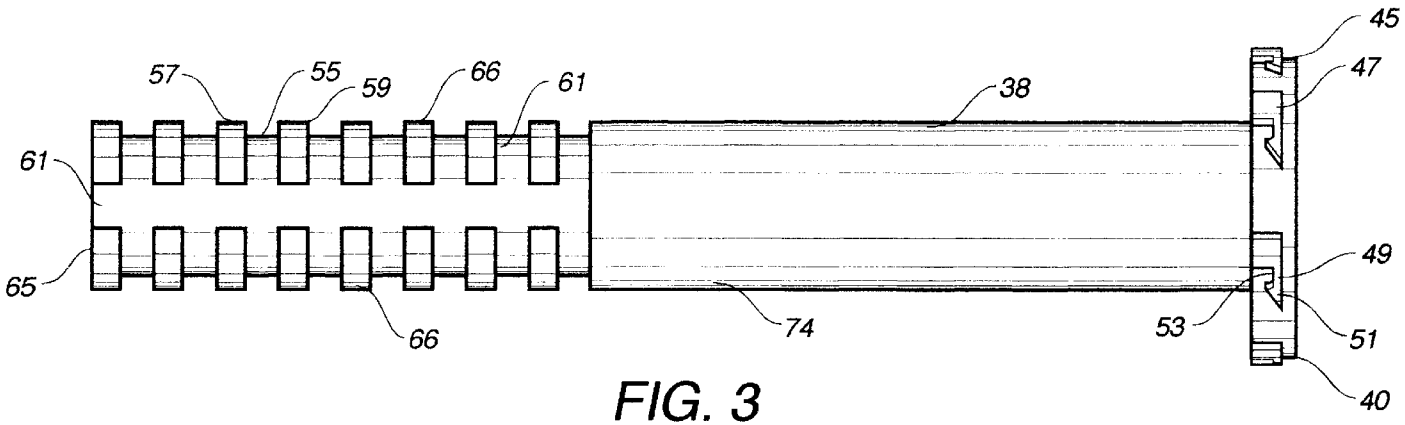
FIG. 3 is a side elevational view showing the tubular member of the present invention.

FIG. 3 shows the configuration of the tubular member 38 of the present invention. As can be seen, the tubular member 38 includes the flanged end 40 at one end of the tubular member 38. A tubular body 74 will extend from the flanged end 40. The flanged end 40 includes an outward circumferential surface 45. The receptacles 47 are formed circumferentially around the surface 45. The receptacles 47 have a special configuration adapted so as to be removably affixed to the button member formed on the interior of the tubular section 37 of the encapsulation of the anchor 34. Specifically, the receptacle 47 includes a slide surface 49 which is formed on the circumferential surface 45. A latch member 51 is formed at an end of the slide surface 49. An abutment portion 53 is formed at an opposite end of the slide surface 49 from the latch member 51. It can be seen that the latch member has a spearhead shape. The wide end of the spearhead shape faces the abutment portion 53. In normal use, and as will be described hereinafter, the button 41 will be received within the area defined by the wide end of the latch member 51, by the slide surface 49, and by the abutment portion 53. When the button member is received in this area of the receptacle 47, the flanged end 40 of the tubular member 38 will be fixedly received on the anchor member 34.

External threads 66 are formed on the tubular body 74 adjacent to the end 65. The external threads 66 allow the securement member 42 to be affixed thereover. The threads 66 have a special configuration in the present invention. As can be seen, the threads 66 are parallel square threads which are formed on the tubular member 38. A space 55 will occur between adjacent threads 57 and 59, for example. A split 61 is formed along the circumference of each of the threads. The split 61 extends for the length of the threaded section of the tubular member 38. The split 61 allows the thread portion on the securement member 42 to slide easily along the length of the threaded section until the abutment surface of the securement member 42 resides against the form board 67. The securement member 42 can be rotated so that the thread portion on the interior of the securement member 42 will reside in the space 55 between adjacent threads. As such, it is not necessary, in the present invention, to continually rotate the securement member so as to draw it into contact with the form board 67. The tubular member 38 is, preferably, formed of a polymeric material.

Figure 4:
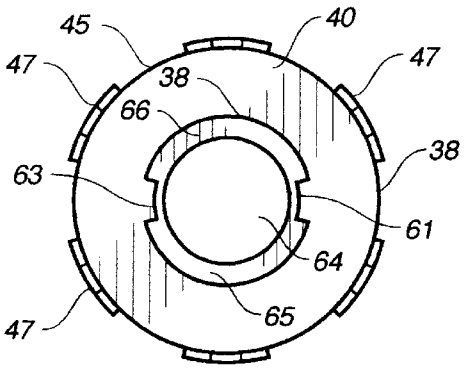
FIG. 4 is an end view of the tubular member of the present invention.

FIG. 4 shows the end 65 of the tubular member 38. As can be seen, the end 65 includes a thread 66 having split 61 on one side and another split 63 at an opposite side. Within the concept of the present invention, several of the splits 61 and 63 could be formed around the circumference of the thread 66. It is only necessary that each of the splits 61 and 63, associated with individual threads, be aligned so that the securement member can slide easily to a desired location. It can be seen that the tubular interior 64 opens at end 65.

In FIG. 4, it can be seen that the flanged end 40 has a greater diameter than the remainder of the tubular section 38. The flanged end 40 has a suitable size for being received within the tubular section 37 of the anchor member 34. It can be seen that a plurality of receptacles 47 extend around the circumferential surface 45 of the flanged end 40.

Figure 5:
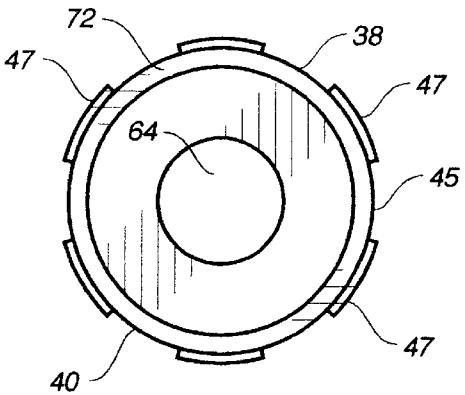
FIG. 5 is an opposite end view of the tubular member of the present invention.

FIG. 5 shows the opposite end view of the tubular member 38. The receptacles 47 are arranged around the circumferential surface 45 of the flanged end 40. An interior seal-abutting surface 72 forms a ring interior of the circumferential surface 45. Surface 42 will contact the compressible seal 43 when the flanged end 40 is installed within the tubular section 37 of the anchor member 34. When a suitable force is applied between the surface 72 and the circumferential surface 43, the receptacles 47 will engage the buttons 41 so as to lock the tubular member 38 in place.

FIG. 5 shows that the tubular interior 64 extends from one end to the other end of the tubular member 38.

Figure 6:
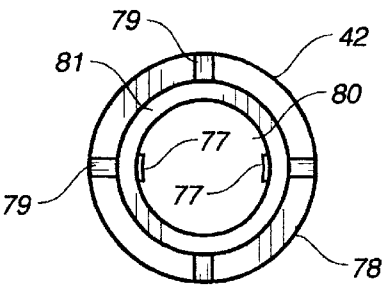
FIG. 6 is an end view of the securement member of the present invention.

FIG. 6 shows an end view of the securement member 42. As can be seen, the securement member 42 includes internal thread portions 77. The internal thread portions 77 engage the external threads 66 of the tubular member 38. Specifically, the thread portions 77 have a length which will fit through the split 61. The thread portions 77 have a thickness suitable for fitting into the space 55. The securement member 42 includes an abutment surface 78 which will be in surface-to-surface contact with the side 67 of the form board 46. Gussets 79 will extend from the forward face 81 of the securement member 42 to the abutment surface 78. As can be seen, the securement member 42 includes an interior bore 80 which will allow the securement member 42 to be placed over the exterior of the tubular member 38.

Figure 7:
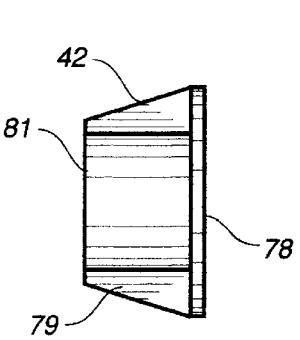
FIG. 7 is a side elevational view of the securement member of the present invention.

FIG. 7 shows the securement member 42. In particular, it can be seen that a flat abutment surface 78 is formed at one end of the securement member 42. The forward face 81 is at the opposite end of the securement member 42. Gussets 79 extend from the forward face 81 to the abutment surface 78. The gussets 79 facilitate the ability to properly position the securement member around the threads 66 of the tubular member 38.

Figure 8:
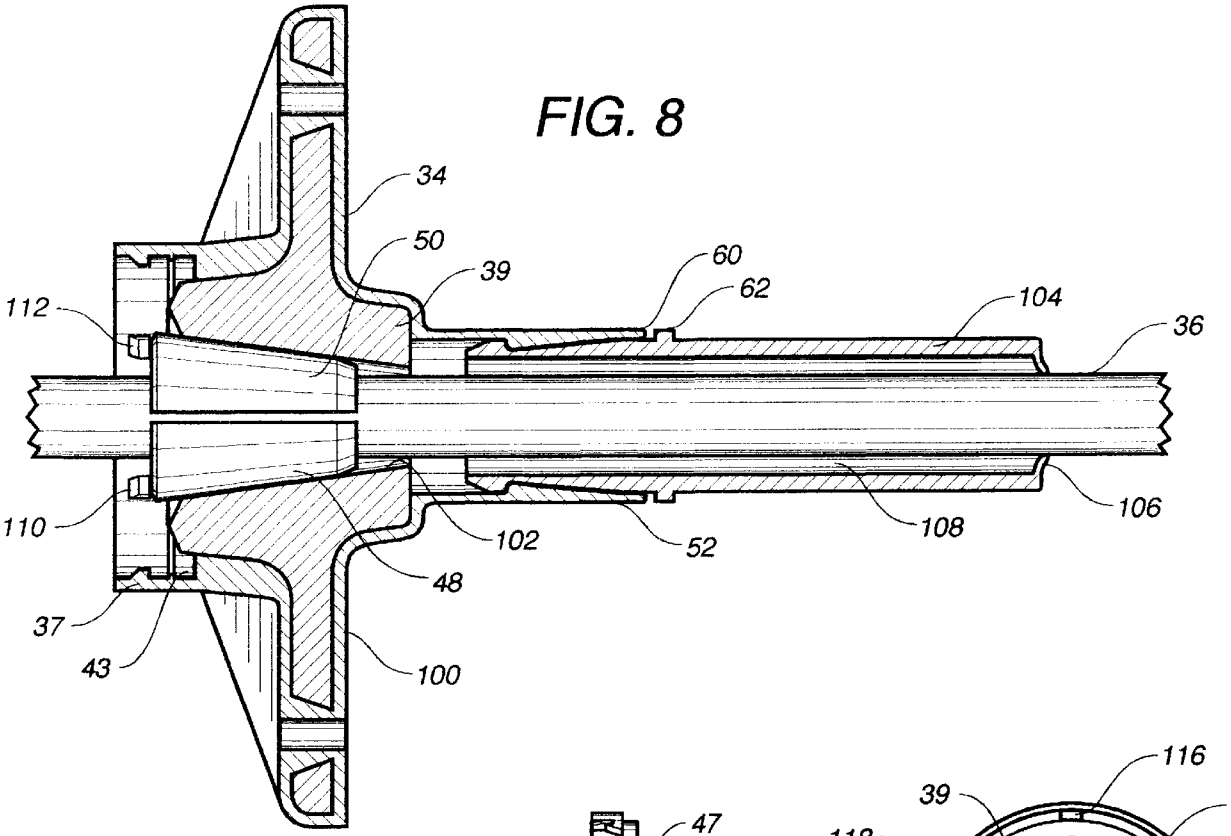
FIG. 8 is a cross-sectional view showing the anchor member of the present invention.

FIG. 8 illustrates the configuration of the anchor member 34. As can be seen, the anchor member 34 has a steel anchor 39 positioned within polymeric encapsulation material 100. The polymeric encapsulation material forms the tubular portion 52 at one end of the anchor member 34. Similarly, the encapsulation 100 will also form the tubular section 37 located opposite the tubular portion 52. The steel anchor 39 has a tapered bore 102 which causes the wedges 48 and 50 to be in friction-fit engagement with the exterior of the tendon 36. Corrosion protection tube 104 has an end received within the tubular portion 52 and a shoulder 62 abutting the end 60 of the tubular portion 52. A sealing end 106 creates a liquid-tight seal between the exterior surface of the tendon 36 and the interior 108 of the corrosion protection tube 104. As such, the seal 106 prevents liquid intrusion into the interior of the anchor member 34.

Importantly, in FIG. 8, it can be seen that button members 110 and 112 are formed on the interior of the tubular section 37. Each of the button members 110 and 112 has a generally rectangular configuration. These button members 110 and 112 will extend in spaced relation around the interior diameter of the tubular section 37. The position of the button members 110 and 112 will correspond to the respective positions of the receptacles 47 formed on the flanged end 40 of the tubular member 38.

It can be seen that the compressive seal 43 is positioned adjacent to the button members 110 and 112 within the interior of the anchor member 34. The compressible seal 43 extends around an outer surface of the steel anchor 39. The encapsulation material 100 will support on a side of the compressive seal 43.

Figure 9:
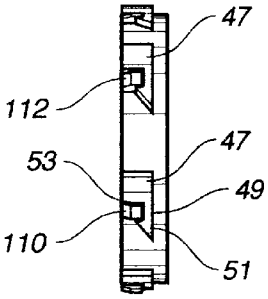
FIG. 9 is a detailed view showing the form of connection between the latch mechanism of the present invention and the button members of the anchor.

FIG. 9 shows the manner in which the button members 110 and 112 are received by the receptacles 47. As can be seen, the button members 110 and 112 are retained in a proper position between the wide end of the spearhead-shaped latch member 51, against an inside surface of the slide area 49 and against a surface of the abutment portion 53.

The button members 110 and 112 are suitably installed by sliding the flanged end 40 of the tubular member 38 into the tubular section 37 of the anchor member 34. The surface 72 of the tubular member 38 will compress against the seal 43 such that the wide end of the spearhead-shaped latch member 51 extends beyond a side of one of the button members. The tubular member 38 is then rotated so that another surface of the button members will contact the abutment portion 53. The tubular member 38 can then be released so that the compressible seal 43 will cause the button members to reside in the locations shown in FIG. 9. To release, it is only necessary to push, rotate and pull the tubular member 38 in the opposite manner.

Figure 10:
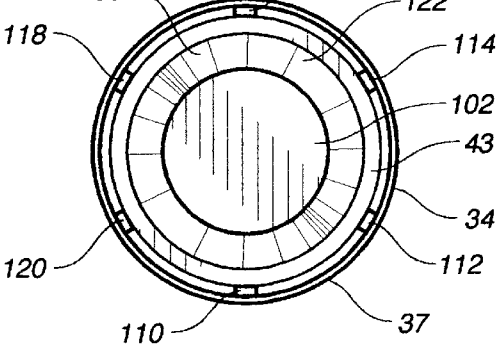
FIG. 10 is an end view showing the tubular section of the anchor of FIG. 8.

FIG. 10 shows an isolated view of the tubular section 37 of the anchor members 34. As can be seen, the button members 110, 112, 114, 116, 118, and 120 extend in evenly spaced relationship around the interior diameter of the tubular section 37. The number of the button members should correspond to the number of the receptacles formed on the circumference of the flanged end 40 of the tubular member 38. In FIG. 10, it can be seen that the compressive seal 43 is formed inwardly of the tubular section 34 and below the button members 110, 112, 114, 116, 118, and 120. The face 122 of the steel anchor 39 faces outwardly of the compressive seal 43. The tapered interior 102 is formed centrally of the steel anchor 39.

Figure 11:
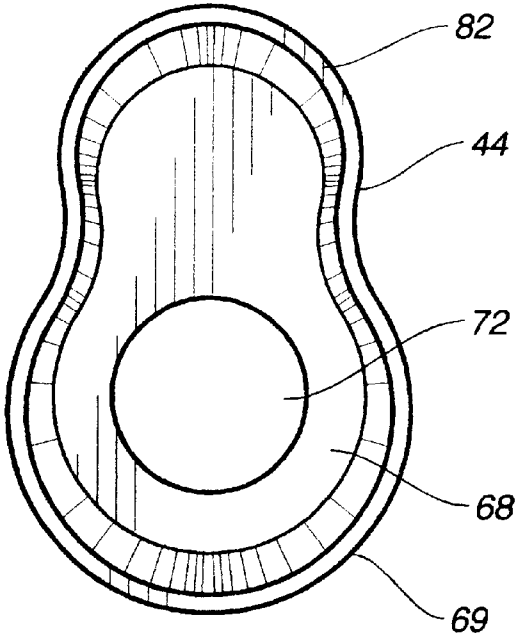
FIG. 11 is an end view of the cup member of the present invention.

FIG. 11 is a view of face 68 of the cup member 44. Cup member 44 has a double oval shape. Face 68 is a generally flat face with tubular opening 72 formed therein. It can be seen that the tubular opening 72 is offset from the center of the face 68. The side 82 of the cup member 44 extends angularly outwardly so as to terminate at back edge 69. The angled side 62 of the cup member 44 facilitates the ability to mold the cup member 44 in an injection molding process. Furthermore, this angled side of the cup member 44 also facilitates the ability to slidably remove the cup member 44 from the concrete after the concrete has solidified.

Figure 12:
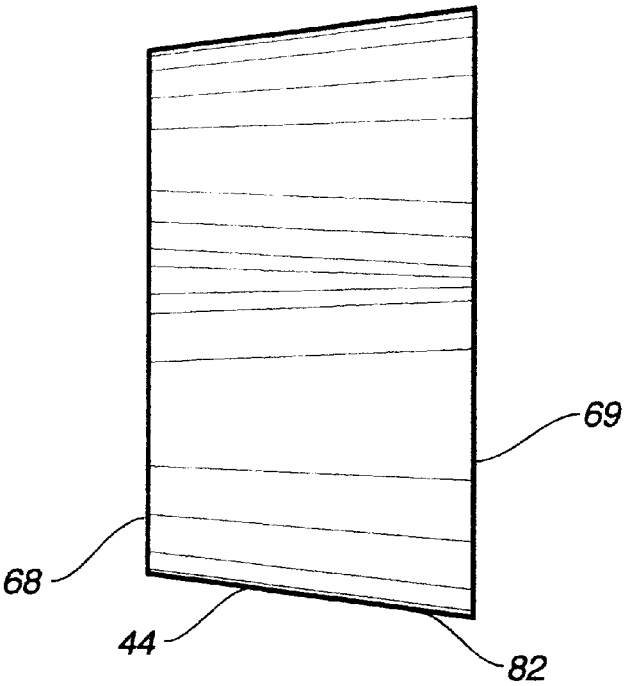
FIG. 12 is a side elevational view of the cup member of the present invention.

FIG. 12 shows a side view of the cup member 44. As can be seen, the sides 82 taper outwardly from the face 68 to the back edge 69. It can be seen that the back edge 69 is of a planar configuration so that the cup member 44 will evenly contact the face 70 of the form board 46.

Figure 13:
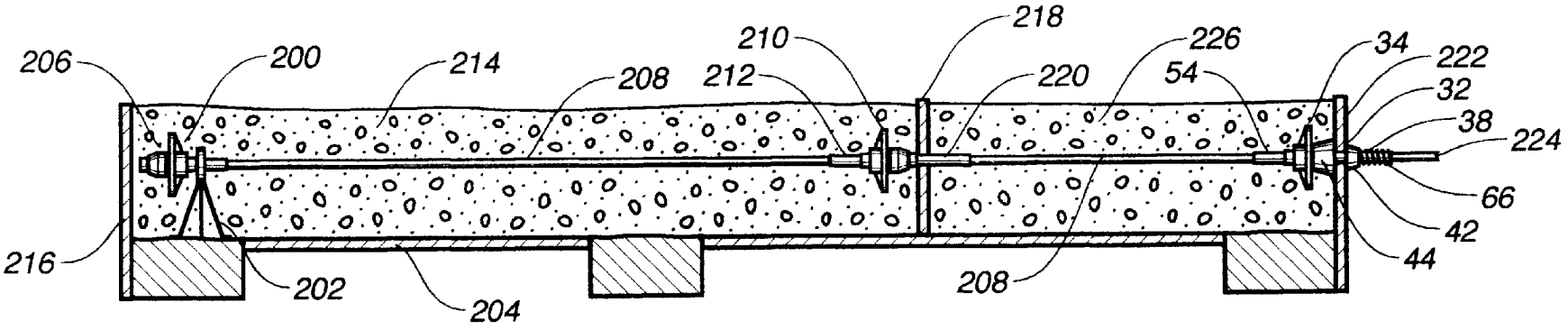
FIG. 13 PRIOR ART
FIG. 13 is a diagrammatic illustration of the installation of the pocketformer apparatus in a post-tension structure.

FIG. 13 shows the installation of the pocketformer apparatus 32 of the present invention. Initially, in the art of post-tension construction, it can be seen that a dead end anchor 200 is positioned on support 202 above face 204. The terminal anchor 200 has a cap 206 including the terminal end of the tendon 208. The terminal end of the tendon 208 is securely affixed within the anchor 200. The tendon 208 will extend from anchor 200 to an intermediate anchorage 210. A corrosion protection tube 212 is placed over the tendon 208 so as to establish a liquid-tight seal between the anchorage 210 and the exterior of the tendon 208. Concrete 214 is then poured into the area between form board 216 and form board 218. After the concrete has solidified, the tendon 208 can be suitably tensioned between anchor 200 and anchor 210. After the tensioning has occurred, a suitable corrosion protection tube 220 can be installed over the exposed end of the tendon 208 which lies on a side of the form board 218. The tendon 208 will extend through the corrosion protection tube 54 and through the interior of the anchor member 34. It can be seen that the cup member 44 is interposed between the form board 222 and the securement member 42. The threaded portion 66 of the tubular member 38 will extend outwardly of the securement member 42. Tendon 208 will then have an end 224 which extends outwardly of the tubular member 38.

As can be seen in the present invention, the anchor member 34 can be suitably secured in position, without the need for nails or screws, by the simple installation of the pocketformer apparatus 32 of the present invention. After the pocketformer apparatus 32 is suitably installed, concrete 226 can then be poured into the area between the form board 218 and the form board 222. After concrete 226 has solidified, the securement member 42 can be removed from the threaded portion 66 of the tubular member 38. By pushing inwardly, rotating and pulling on the threaded end 66 of the tubular member 38, the cup member 44 and the tubular member 38 can be suitably removed. This will leave a pocket in the concrete 226 suitable for the tensioning of the tendon 208.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A pocketformer apparatus for a post-tension anchor system comprising:

a tubular member having an outwardly flanged end, said tubular member having an interior passageway extending from said flanged end to another end, said flanged end having means thereon for snap-fit engagement with an anchor of the post-tension anchor system, said means for engagement comprising a slide surface formed on a periphery of said flanged end, said slide surface having a latch member at an end thereof said slide surface having an abutment portion at an end opposite said latch member;

a securement member affixed to said tubular member; and a cup member having an interior opening, said tubular member extending through said interior opening, said cup member interposed between said flanged end and said securement member on said tubular member.

2. The apparatus of claim 1, said tubular member having an externally threaded area extending inwardly of said another end, said securement member being fixed in position on said externally threaded area.

3. The apparatus of claim 2, said securement member having an interior bore, said interior bore having a thread section formed therein, said thread section in said interior bore engaging said externally threaded area of said tubular member.

4. The apparatus of claim 2, said securement member slidable on said externally threaded area so as to draw said flanged end toward a face of said cup member, said securement member being rotatable so as to be fixed in position on said tubular member.

5. The apparatus of claim 1, said securement member having an abutment surface facing said flanged end.

6. The apparatus of claim 1, said latch member having a spearhead shape, said slide surface extending circumferentially around a portion of said flanged end, said spearhead shape of said latch member having a wide end facing said abutment portion.

7. A pocketformer apparatus for a post-tension anchor system comprising:

a tubular member having an outwardly flanged end, said tubular member having an interior passageway extending from said flanged end to another end, said flanged end having means thereon for snap-fit engagement with an anchor of the post-tension anchor system;

a securement member affixed to said tubular member; and a cup member having an interior opening, said tubular member extending through said interior opening, said cup member interposed between said flanged end and said securement member on said tubular member, said cup member having a double oval shape, said cup member having a face at a narrow end of said double oval shape, said face being proximal said flanged end.

8. The apparatus of claim 7, said cup member having a wide end distal said flanged end, said wide end being open with a planar edge.

9. The apparatus of claim 1, said tubular member, said securement member and said cup member being formed of a polymeric material.

10. The apparatus of claim 7, said interior opening being a tubular section opening at one end on said face, said tubular section opening at an opposite end at said wide end of said cup member, said tubular section having a diameter greater than a diameter of said tubular member.

11. The apparatus of claim 10, said interior opening offset from a center of said face of said cup member.

12. A post-tension anchorage system comprising:

an anchor member;

a tendon extending through an interior of said anchor member;

a tubular member having a flanged end, said flanged end being removably affixed in snap-fit engagement with said anchor member, said tendon extending through an interior of said tubular member said flanged end having a receptacle means formed thereon, said receptacle means for detachably receiving a button member formed on said anchor member;

a cup member with an interior opening, said tubular member extending through said interior opening; and a securement member affixed to said tubular member such that said cup member is interposed between said anchor member and said securement member.

13. The system of claim 12, further comprising:

a form board having a hole extending therethrough, said tubular member extending through said hole, said form board interposed between said cup member and said securement member.

14. The system of claim 13, said cup member having a double oval shape, said cup member having a face at a narrow end in contact with said anchor member, said cup member having a wide end in surface-to-surface contact with a surface of said form board.

15. The system of claim 14, said securement member being threadedly affixed to said tubular member, said securement member rotatable so as to fix a position of said securement against said form board.

16. The system of claim 12, said anchor member being covered with a polymeric encapsulation, said encapsulation having a tubular section formed adjacent an end of said anchor member, said button member being formed inwardly of said tubular section, said flanged end affixed within said tubular section.

17. The system of claim 16, said receptacle means comprising:

a slide surface formed on a circumference of said flanged end;

a latch member formed at an end of said slide surface; and an abutment portion formed at an opposite end of said slide surface, said button member being positioned against said slide surface and said abutment portion when said flanged end is in snap-fit engagement within said tubular section.

18. The system of claim 17, said latch member having a spearhead shape, a wide end of said spearhead shape abutting a surface of said button member opposite said abutment portion.

19. The system of claim 16, said anchor member having a compressible seal member positioned within said polymeric encapsulation at said tubular section, said flanged end being in contact with said compressible seal when said flanged end is in snap-fit engagement with said anchor member.

20. The system of claim 12, said tubular member having an externally threaded area, said securement member being threadedly received by said externally threaded area.

21. The system of claim 20, said externally threaded area of said tubular member having threads with a split formed therebetween, said securement member having an internal thread section formed therein, said internal thread section having a length less than a length of said split.

22. The system of claim 21, said externally threaded area comprising a plurality of parallel threads extending along a portion of the length of said tubular member, said split extending along said portion of said length.

23. The system of claim 12, said interior opening comprising a tubular section extending through an interior of said cup member, said tubular member slidably received within said tubular section of said cup member.

24. The system of claim 23, said tubular section of said cup member opening at a face of said cup member adjacent said anchor member, said tubular section having a longitudinal axis offset from a center of said face.

* * * * *